US005594419A

United States Patent [19]

Lo

[11] Patent Number: 5,594,419

[45] Date of Patent: Jan. 14, 1997

[54] TABLE-EDGE HANGER

[76] Inventor: Allen K. W. Lo, 5022 Hidden Branches Dr., Dunwoody, Ga. 30338

[21] Appl. No.: 584,281

[22] Filed: Jan. 11, 1996

[51] Int. Cl.[6] ..... G08B 13/14; A44B 21/00

[52] U.S. Cl. ..... 340/568; 248/339; 248/551; 340/666; 340/693

[58] Field of Search ..... 340/568, 666, 340/693; 24/3 R; 248/551, 339

[56] References Cited

U.S. PATENT DOCUMENTS 918,088 4/1909 Poppertt ..... 340/568

3,685,037 8/1972 Bennett et al. ..... 340/666

4,274,088 6/1981 Pierson et al. ..... 340/568

*Primary Examiner*—Glen Swann

[57] ABSTRACT

A table-edge hanger having a hook for hanging a personal item such as a purse or a jacket. The hook may be movably attached so it can swing side to side. The hanger can also have a decorative attachment which can be a timepiece for keeping time. Preferably, the hanger has a microswitch for triggering an alarm if the personal item is removed from the hook or removed from the table together with the hanger. The alarm can be disabled with an on/off switch if desired.

8 Claims, 2 Drawing Sheets

TABLE-EDGE HANGER

FIELD OF THE INVENTION

The present invention relates to a hanger with a hook that can be placed against the edge of a table or a counter for hanging a personal item such as a purse or a jacket.

BACKGROUND OF THE INVENTION

In a restaurant, it is not unusual to see that people leave their purses on the table or on the floor, or their jackets on the back of a chair while they dine. By doing so, they risk losing those personal items to petit-theft. It is desirable to provide a table-edge hanger for hanging a personal item next to the owner. Furthermore, the hanger may be equipped with an anti-theft warning device.

SUMMARY OF THE INVENTION

The present invention provides a hanger that can be placed against the edge of a table or a counter-top. The hanger has a hook for hanging a purse or other personal items. The hanger can have a timer or a watch attached thereon to keep time. Moreover, a microswitch can be installed on the hanger where the hanger rests on the table edge such that when the personal item is taken off the hook or it is removed from the table together with the hook, the microswitch will trigger an alarm unless the alarm is disabled or reset by another switch. An indicator light may also be placed on the hanger to indicate whether the alarm is enabled or disabled.

It is the object of the present invention to provide a hanger for hanging a purse, a jacket or other personal items on the edge of a table or a counter-top for convenience.

It is another object to the present invention to provide a hanger with an attachment such as a watch or a timer for telling time, or a decorative design to make the hanger more appealing.

It is yet another object of the present invention to provide a hanger with an alarm which is triggered to give off a warning signal unless the alarm is disabled.

DETAILED DESCRIPTION OF THE INVENTION

Figure 1:
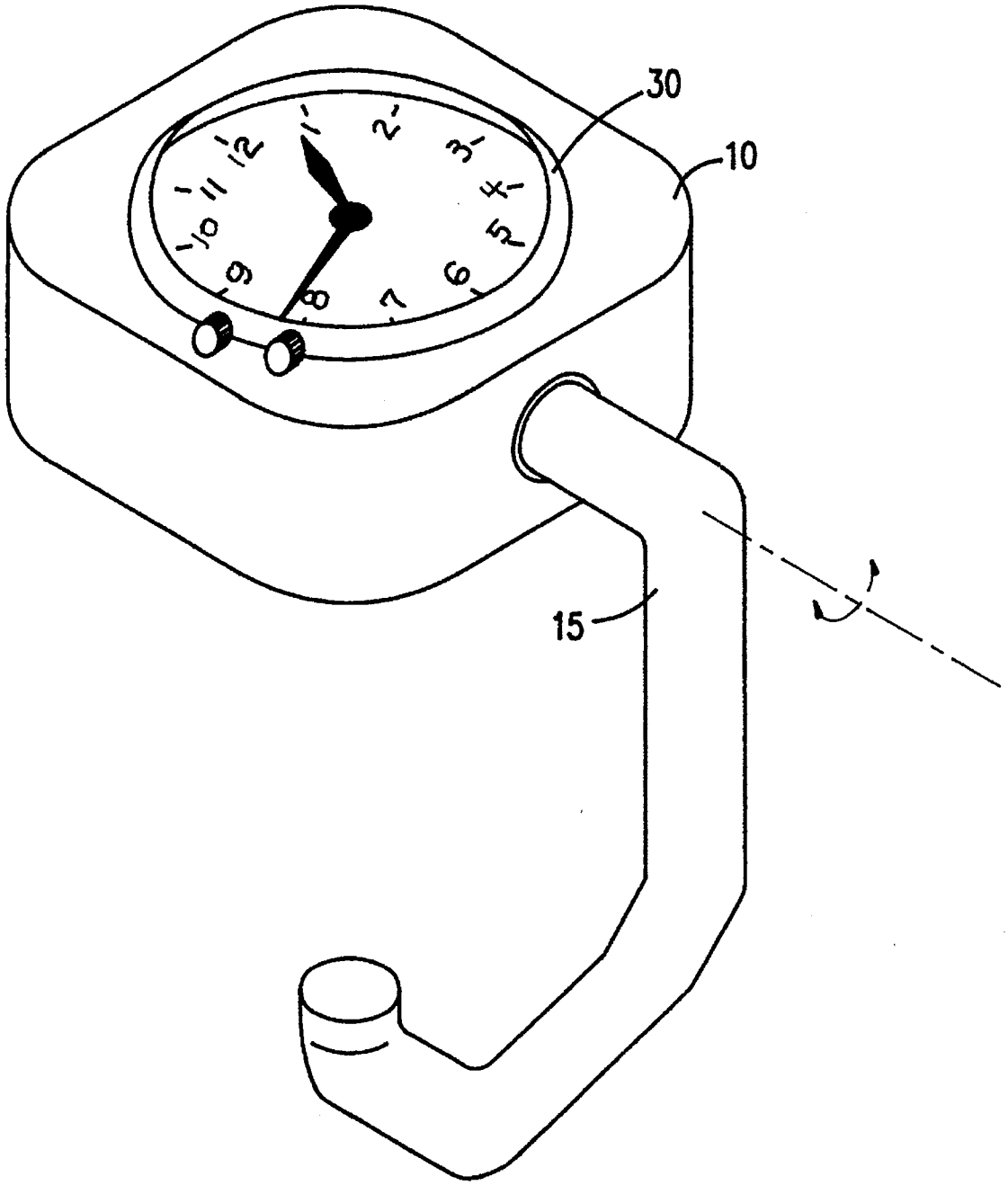
FIG. 1 illustrates a preferred embodiment of the table-edge hanger with a timepiece.

FIG. 1 illustrates a preferred embodiment of the table-edge hanger, according to the present invention. In FIG. 1, numeral 10 denotes a base for placing the hanger against the edge of a table or a counter-top. A hook 15 is attached to the base 10 for hanging one or more personal items such as a purse or a jacket. Preferably, the hook is movably attached to the base such that it can swing side to side about an pivotal axis as indicated by the broken line with arrows. Numeral 30 denotes a decorative attachment on the hanger. Preferably, the attachment 30 comprises a timepiece for telling time, as shown in FIG. 1.

Figure 2:
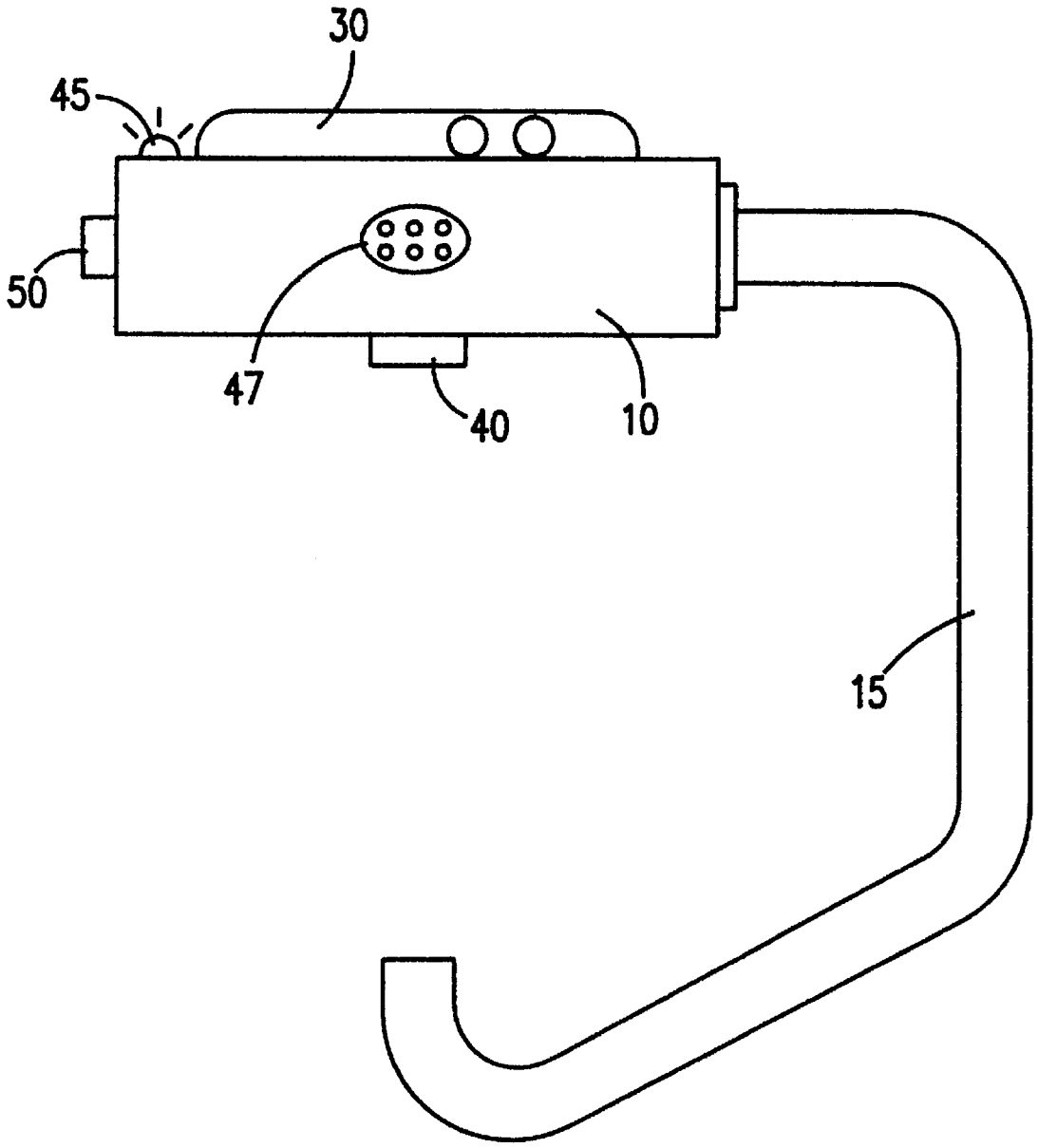
FIG. 2 illustrates another embodiment of the table edge hanger with an alarm means.

FIG. 2 illustrates another embodiment of the table-edge hanger, according to the present invention. As shown in FIG. 2, this embodiment is basically the same as that shown in FIG. 1 except that more components are added thereon. As shown, a microswitch 40 is installed on the underside of the base 10 such that the microswitch is turned on when a personal item is placed on the hook while the hanger is placed against an edge. The hanger is also equipped with an alarm means 47 which gives out warning light or sound when triggered. If the personal item is taken off the hook 15 or the base 10 is lifted off the edge while the microswitch is turned on, the alarm means 47 is triggered to give out a warning signal. The hanger is also equipped with an on/off switch 50 located at a rather inconspicuous place, which is used to turn off the alarm means 47. The switch 50 can also be used to disable the alarm means 47 to prevent microswitch 40 from triggering the alarm means 47, when desired. It is preferred that an indicator light 45 is placed on the hanger to indicate that the alarm means 47 is in the "enabled" or "disabled" state. In the "disabled" state, the alarm means 47 will not be triggered by the microswitch 40.

It is understood that the hanger is also equipped an electronic circuit for controlling the alarm means and at least one battery in a battery compartment to supply power to the electronic circuit and the alarm. The electronic circuit, the battery and the battery compartment are not shown.

What is claimed is:

1. A table-edge hanger comprising:

a base for placing against the edge of a table or a counter-top;

a hook connected to one side of said base; and a decorative attachment attached to another side of said base.

2. The hanger of claim 1 wherein said hook is movably connected to said base for swinging from side to side.

3. The hanger of claim 1 wherein said decorative attachment comprises a timepiece.

4. A table-edge hanger comprising:

a base for placing against the edge of a table or a counter-top;

a hook connected to one side of said base;

an alarm;

a first switch on another side of said base; and a second switch;

wherein said first switch is turned on when a personal item is placed on said hook while said base is replaced against the edge of a table or a counter-top;

wherein said first switch triggers said alarm when said personal item is removed from said hook or said base is lifted off said edge if said first switch has been turned on;

wherein said alarm can be turned off by activating said second switch;

wherein said alarm can be disabled by activating said second switch to prevent said alarm being triggered by said first switch when desired.

5. The hanger of claim 4 further comprising a decorative attachment.

6. The hanger of claim 5 wherein said decorative attachment comprises a timepiece.

7. The hanger of claim 4 wherein said hook is movably attached to said base.

8. The hanger of claim 4 further comprising an indicator light for indicating whether said alarm has been disabled.

* * * * *